US005816422A

United States Patent [19]

Roig

[11] Patent Number: 5,816,422

[45] Date of Patent: Oct. 6, 1998

[54] PACKAGE WITH SAFETY LID AND SEAL

[75] Inventor: Armand Puiggros Roig, Polinya, Spain

[73] Assignee: C.T.X., S.A., Polinya, Spain

[21] Appl. No.: 721,756

[22] Filed: Sep. 30, 1996

[30] Foreign Application Priority Data

Sep. 28, 1995 [ES] Spain ..... 9502494

[51] Int. Cl.[6] ..... B65D 17/40; B65D 41/34; B65D 50/08

[52] U.S. Cl. ..... 215/209; 215/221; 215/250; 220/266; 220/270; 220/276; 220/281; 220/288

[58] Field of Search ..... 215/209, 213, 215/214, 217, 221, 250, 253, 254, 255, 256, 329, 330, 331, 201; 220/265, 266, 270, 276, 281, 288

[56] References Cited

U.S. PATENT DOCUMENTS

| | | | |
|---|---|---|---|
| 3,019,931 | 2/1962 | Thornton | 215/221 |
| 3,390,799 | 7/1968 | Szekely | 215/221 |
| 3,850,329 | 11/1974 | Robinson | 215/254 |
| 3,892,326 | 7/1975 | Schneible | 215/221 |
| 3,895,731 | 7/1975 | Coursaut | 215/221 X |
| 4,061,239 | 12/1977 | Tasseron | 215/221 |
| 4,103,797 | 8/1978 | Morris . | |
| 4,427,124 | 1/1984 | Marshall et al. | 215/209 X |
| 4,512,485 | 4/1985 | Agbay et al. | 215/221 X |
| 5,230,433 | 7/1993 | Hamilton et al. . | |
| 5,249,694 | 10/1993 | Nelson | 220/266 X |
| 5,413,233 | 5/1995 | Hall | 215/330 X |
| 5,664,693 | 9/1997 | Krall | 215/221 X |

FOREIGN PATENT DOCUMENTS

| | | |
|---|---|---|
| 0 050 490 A1 | 4/1982 | European Pat. Off. . |
| 359611 | 2/1962 | Switzerland . |

*Primary Examiner*—Allan N. Shoap
*Assistant Examiner*—Niki M. Kopsidas
*Attorney, Agent, or Firm*—McGlew and Tuttle

[57] ABSTRACT

Package with safety lid and seal including a cylindrical body with a lid coupled by a thread at the mouth thereof and which includes an outside coaxial skirt having projections on its inside face. It is characterized in that the package body comprises around the body a seal made up with a strap weakly joined to this body, this strap having on the periphery, at least, one recess into which the corresponding projection of the skirt of the lid is fitted, preventing in this way the unscrewing of the lid. One of the ends of the sealing strap includes a handlelike extension facilitating through pulling, the tearing off and separation of the sealing strap with respect to the package body.

6 Claims, 2 Drawing Sheets

PACKAGE WITH SAFETY LID AND SEAL

FIELD OF THE INVENTION

This invention concerns a package with safety lid and seal.

BACKGROUND OF THE INVENTION

Various systems are already known for closing cans and bottles with safety lids and stoppers. Some of them are provided with a seal and many of such packages are devised for containing toxic products which might be detriment to health and that therefore should be kept out of the way of children before opening or emptying the packages.

From among these known packages, there are those comprising a body basically cylindrical with a lid coupled by means of a thread at the mouth thereof and which comprises an outside coaxial skirt showing on its inside face projections that meet other projections of the body of the package in order to stand in the way of opening.

SUMMARY AND OBJECTS OF THE INVENTION

It is precisely such kind of packages that become improved as a result of the present invention, particularly characterized by the fact that the lid offers safety with the seal attached and also after it is removed.

For this purpose it is characteristic in the present invention to have around the body of the package a seal made up of a strap or ring weakly joined to the body and showing on the periphery at least one recess into which will fit the corresponding projection of the skirt of the lid, thus standing in the way of the unscrewing. One of the ends of the sealing strap includes a handlelike extension facilitating through pulling, the tearing off and separation of the sealing strap with respect to the body of the package.

It is also characteristic of the present invention that the body of the package has on its periphery an elastic projection incorporating a tooth as a safety means against unscrewing of the lid after the seal is removed. The tooth stands in the way of the projections in the skirt of the lid as the latter is being unscrewed, and that the tooth is avoided when the elastic projection is pressed down.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
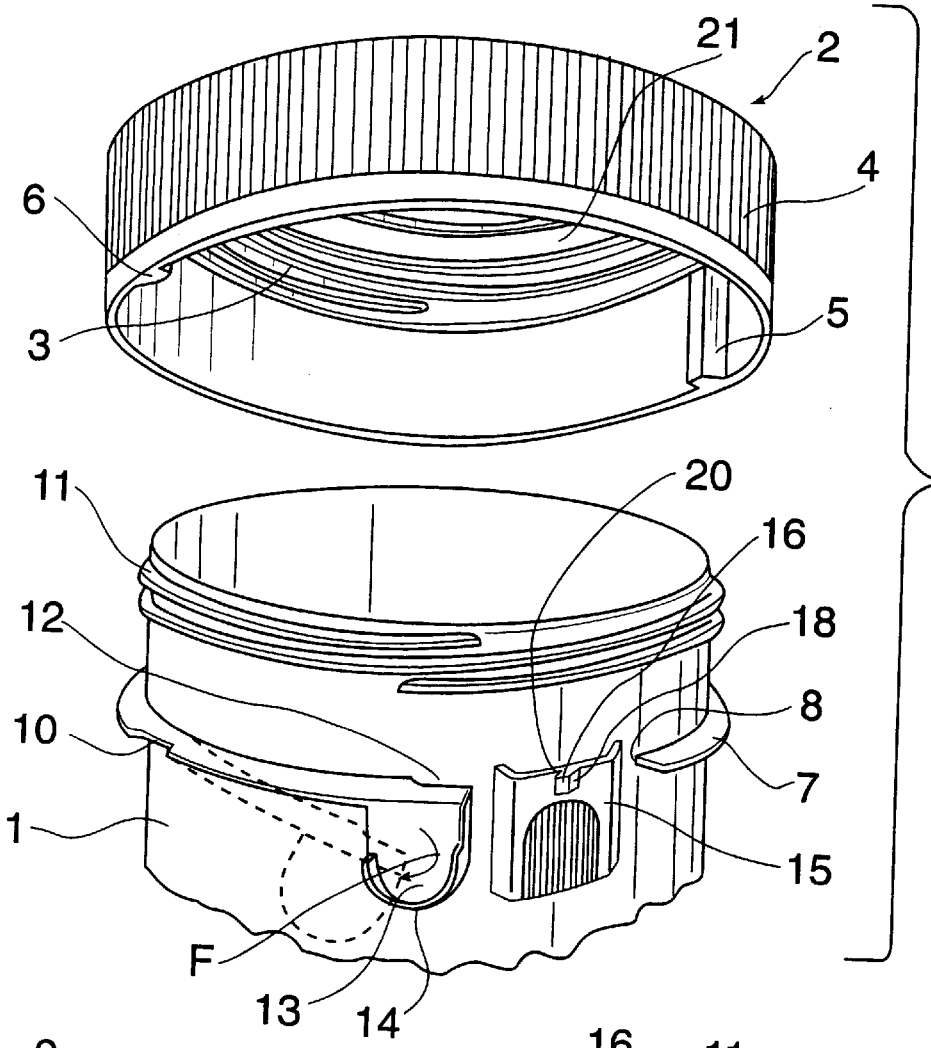
FIG. 1 is a perspective view of the top of the body of the package and the lid, uncoupled.
Figure 2:
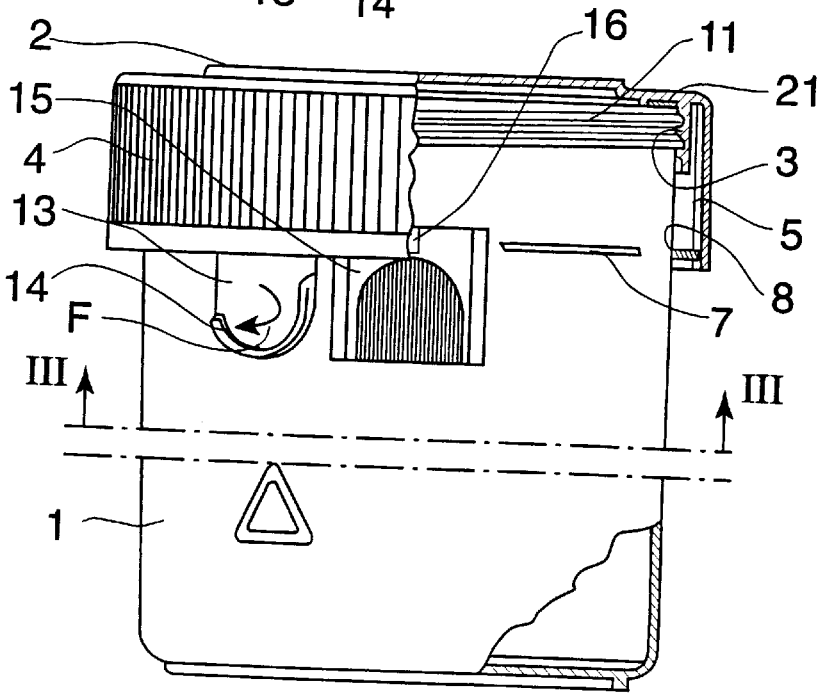
FIG. 2 is a partial cut view of an elevation of the package, complete and closed, FIGS. 3 and 4 correspond to a cross section view of the package along line III—III of FIG. 2 with and without a seal respectively.
Figure 3:
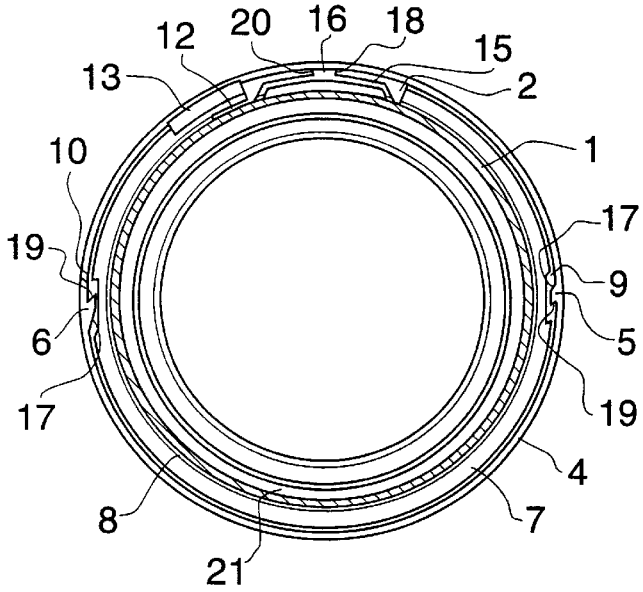

According to the drawings, the package comprises a body essentially cylindrical 1 and a circular lid 2. The lid shows an inside thread 3 and an outside coaxial skirt 4 which in two diametrically opposed spots has inside corresponding lid projections 5 and 6.

Around the body 1 of the package is formed a seal made up a of strap or ring 7 weakly joined through an edge or attachment means 8 to the body. On the strap 7, two recesses 9 and 10 have been incorporated and are diametrically opposed on its periphery. The two recesses 9 and 10 recieve projections 5 and 6 respectively of the skirt of the lid. This prevents the unscrewing of the lid after the lid has been coupled through axial pressure to the mouth of the body 1 of the package avoiding the outside thread 11 of the periphery thereof thanks to the semi-resiliency of the material of which body and lid were manufactured, to the slight gap there is between the threads of either, and to the slant planes comprising them.

One of the ends of the sealing strap or ring 7 is already separated from the body 1 along a short length 12. The short length of 12 comprises an expansion or extension 13 with a rim 14 that facilitates in a handlelike way, by pulling as shown by arrow F, the tearing off and separation of the sealing strap 7 with regard to the body of the package. The short length 12 and the expansion 13 being removal means.

Figure 4:
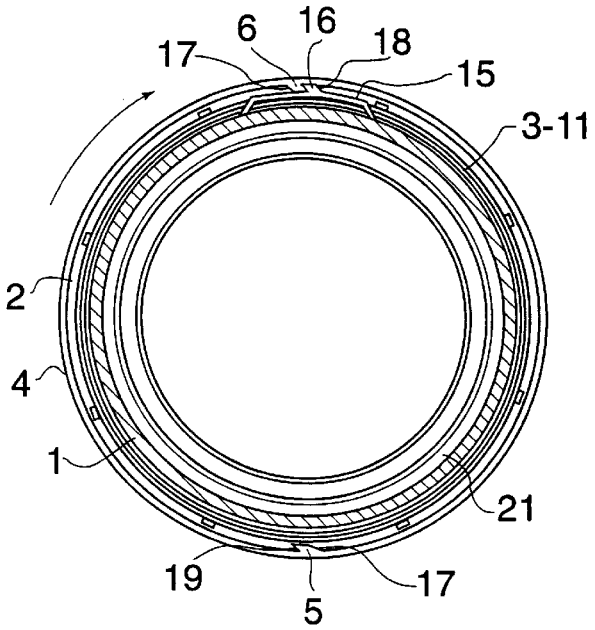
Figure 5:
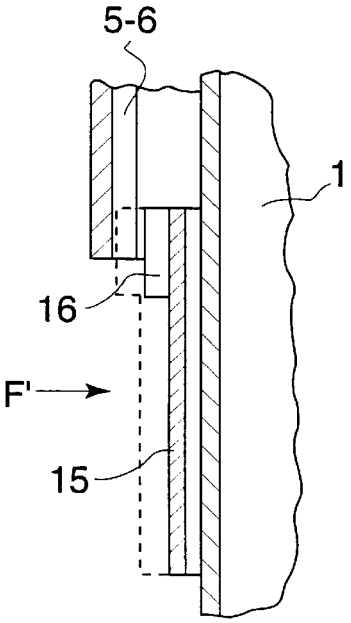
FIG. 5 is a detailed cut elevation of the safety means which operate after the seal is removed.

Sealing strap 7 leaves free a small area of the periphery of body 1, where the body has a body projection 15 forming a resilient bridge bearing a tooth 16 aligned with the sealing strap 7 to serve as the safety medium against unscrewing of the lid after the sealing strap has been removed, since the tooth 16 collides with the projections 5 and 6 of the skirt of the lid when the latter turns (FIG. 4). To unscrew the lid, the obstacle of tooth 16 can be avoided by pressing projection 15 in a direction as shown by arrow F' in FIG. 5, whereby the projection bends towards the body 1, thus tooth 16 ceases to prevent the passage of projections 5 and 6 of the skirt of the lid.

To facilitate screwing the lid on the body of the package, the projections 5 and 6 of the skirt of the lid and the tooth 16 present slanted planes 17 and 18, and opposite to such slanted planes the projections and the tooth comprise respective angular recesses 19 and 20 to establish a fit between each other to ensure blocking of the unscrewing of the lid.

To obtain watertight closure of lid 2 on body 1, the former has on the inside periphery of the bottom, the coupling of gasket 21.

It is understandable that the sealing strap could have one single recess on the periphery. On such case, one of the projections of the skirt of the lid would coincide with the recess, and the other projection would coincide with the tooth of the elastic projection corresponding to the body of the package.

I claim:

1. A package comprising:

a body;

a lid connectable to said body by means of threads, said lid having a skirt positionable around and coaxial with an end of said body;

a lid projection positioned on an inside of said skirt;

a ring around said end of said body, said ring defining a recess for receiving said projection and blocking rotation of said lid with respect to said body;

attachment means for weakly attaching said ring to said body;

a body projection positioned on said body;

a tooth positioned on said body projection for colliding with said lid projection when said lid is rotated with respect to said body;

said body projection including means for positioning said tooth out of collision with said lid projection when said body projection is pressed.

2. A package in accordance with claim1, wherein:

removal means is incorporated into said ring for removing said ring from said body, said removal means including a handle type extension for gripping by an operator of the package to tear and separate said ring from said body.

3. A package in accordance with claim 2, wherein:

said removal means including a length of said ring being separated from said body.

4. A package in accordance with claim 1, wherein:

said lid projection and said tooth have shaped surfaces for passing said lid projections past said tooth in a screwing direction of said lid onto said body and for blocking movement of said lid projections past said tooth in unscrewing directions of said lid.

5. A package comprising:

a body having body threads on one end of said body;

a lid connectable to said body by means of lid threads, said lid having a skirt positionable around and coaxial with said end of said body;

a lid projection positioned on an inside of said skirt;

a ring around said end of said body, said ring defining a recess for receiving said projection and blocking rotation of said lid with respect to said body;

attachment means for attaching said ring to said body in a manner for removal of said ring from said body by an operator of the package without damaging one of said body and said ring, a body projection positioned on said body;

a tooth positioned on said body projection for colliding with said lid projection when said lid is rotated with respect to said body;

said body projection including means for positioning said tooth out of collision with said lid projection when said body projection is pressed.

6. A package in accordance with claim 5, wherein:

said body and lid threads have means for connecting said lid to said body by axial movement of said lid onto said end of said body;

said lid projection and said recess are positioned to have said body and lid threads engage in a screwed down position when said lid projection is positioned in said recess.

* * * * *